United States Patent [19]

Hawrylenko

[11] 4,047,704

[45] Sept. 13, 1977

[54] SHAKING MACHINE COMPRISING AT LEAST SUPPORTS FOR THE TREATED MATTER

[75] Inventor: Alexander Hawrylenko, Bottmingen, Switzerland

[73] Assignee: Infors AG, Switzerland

[21] Appl. No.: 635,315

[22] Filed: Nov. 26, 1975

[30] Foreign Application Priority Data

Jan. 1, 1975 Germany ..... 2503631

[51] Int. Cl.[2] ..... B01F 11/00; B08B 3/12; B01F 9/00; B01F 13/00

[52] U.S. Cl. ..... 259/1 R; 259/DIG. 42; 259/54

[58] Field of Search ..... 259/1 R, 54, 56, 72, 259/DIG. 42; 209/366, 366.5

[56] References Cited

U.S. PATENT DOCUMENTS

| | | | |
|---|---|---|---|
| 3,032,200 | 5/1962 | Miller | 209/366 |
| 3,430,926 | 3/1969 | Freedman | 259/54 |

FOREIGN PATENT DOCUMENTS

| | | | |
|---|---|---|---|
| 492,484 | 8/1970 | Switzerland | 259/54 |
| 553,009 | 8/1974 | Switzerland | 259/54 |

*Primary Examiner*—Harvey C. Hornsby
*Assistant Examiner*—Robert Pous
*Attorney, Agent, or Firm*—McGlew and Tuttle

[57] ABSTRACT

The shaking machine comprises a frame in the form of a base in which there is mounted a driving motor which rotates two vertically oriented shafts on which at least two supports are mounted in vertically spaced relation. Each support has two bearing bodies, each having a central bore receiving an eccentric member rotatable with a respective shaft so that, as the shafts are rotated, all points of each support execute horizontal circular movements at mutually equal velocities along paths having mutually equal radii. In one embodiment of the invention, a respective sector shape balance body is mounted for rotation, about a vertical axis at the center of gravity of the support. The eccentric secured to one shaft is in the form of a gear which is connected by a gear belt to a gear secured to rotate with the balance body. In another embodiment of the invention, each shaft has secured thereto, with respect to each support, a respective sector shape balance body. The balance bodies, in both embodiments, have dimensions such that the inertia forces occurring during operation of the machine, and the torques produced thereby, substantially compensate each other.

3 Claims, 4 Drawing Figures

SHAKING MACHINE COMPRISING AT LEAST SUPPORTS FOR THE TREATED MATTER

FIELD AND BACKGROUND OF THE INVENTION

This invention relates to a shaking machine comprising a frame, a drive mechanism, and at least two supports for the treated matter, which supports are mounted one above the other and are guided and connected to the drive mechanism in a manner such that, in operation, all points of the supports can execute horizontal circular movements at mutually equal velocities and, along paths having mutually equal radii.

Such shaking machines are used, for example, in the cultivation of microorganisms. There, the exchange of substances and, particularly, gases between the microorganisms and the nutrient, substantially depends on the path velocity of the support carrying the matter. If a shaking process is involved requiring a high path velocity, correspondingly high inertia forces, namely centrifugal forces, occur. Thereby, the bearings are highly stressed. In addition, such forces produce tilting moments acting on the frame of the shaking machine and capable of causing uncontrollable rolling motions.

Various designs of shaking machines in which the inertia forces and tilting moments are compensated are already known. For example, Swiss Pat. No. 492,484 discloses a shaking machine comprising a single drive shaft. The drive shaft is provided with a crank acting on the support or supports, carrying the matter, at the center of gravity thereof. The drive shaft is further provided with a counterweight which is located opposite the crank. The counterweight is dimensioned so that the common center of gravity of the support and the counterweight is located on the axis of rotation of the shaft, whereby the centrifugal forces occurring during operation and the torques thereby produced are balanced. This design is advantageous for shaking machines comprising only one support for the matter to be treated. Various drawbacks appear, however, with the use of shaking machines having several supports mounted one above the other.

First, it is necessary to dispose the drive shaft approximately at the center of the machine, so that the shaft must extend through the supporting surfaces of at least those supports which are located below the counterweight. This means that a relatively large area must be left free at the center of the supports. Since, ordinarily, the vessels to be shaken are placed on the supports not individually but in groups on trays, such a necessity results in a great loss of space.

Further, a design with several supports has the disadvantages that the number of supports and their height cannot be varied without particular attention since, otherwise, the common center of gravity of the supports and that of the counterbalance will not lie in the same plane. In view of the fact, however, that the vessels to be shaken frequently have very different heights, it would be very useful in many cases to have the possibility of varying the number of the supports and their spacing.

Another drawback of the mentioned design, is that the uppermost and lowermost supports are located relatively far from the plane of the counterweight. Since, in general, the masses of the vessels placed on the different supports do not exactly correspond to the provided values and frequently also differ from each other, relatively great tilting moments may be produced.

There is also known a shaking machine, disclosed in Swiss Pat. No. 553,009, comprising a plurality of supports for the matter to be treated, and which are carried by a plurality of columns. In this design, the forces are balanced so that the different supports perform circular motions which are dephased relative to each other. Also, the columns are provided laterally of the supports so that the central portions of the supports can be utilized without loss of space. Otherwise, however, this design has drawbacks similar to those of the machine described above, since, again, a satisfactory balancing is obtained only as long as the machine is equipped with the provided number of supports of which each is located at the right level.

SUMMARY OF THE INVENTION

The present invention is directed to a shaking machine in which the number and level of the supports for the matter to be treated is variable without running the risk of thereby producing tilting moments.

In accordance with the invention, there is provided a shaking machine, of the kind mentioned, in which each support is connected to at least one balance body which is mounted for rotation in a manner such that, during operation, its center of gravity executes a horizontal circular movement which is dephased relative to the movement of the center of gravity of the support by a constant phase angle, and the balance body or bodies are disposed and dimensioned in a manner such that the inertia forces occurring during operation, as well as the torque thereby produced, approximately compensate each other.

An object of the invention is to provide an improved shaking machine for use, for example, in the cultivation of microorganisms.

Another object of the invention is to provide such an improved shaking machine including at least two supports arranged one above the other and in which the inertia forces, occurring during operation, as well as the torques thereby produced, substantially compensate each other.

A further object of the invention is to provide such an improved shaking machine in which each support is connected to at least one balance body rotatable relative thereto in a manner such that, during operation, its center of gravity executes a horizontal circular movement which is dephased relative to the movement of the center of gravity of the support by a constant phase angle.

For an understanding of the principles of the invention, reference is made to the following description of typical embodiments thereof as illustrated in the accompanying drawings.

DESCRIPTION OF THE PREFERRED EMBODIMENTS

Figure 1:
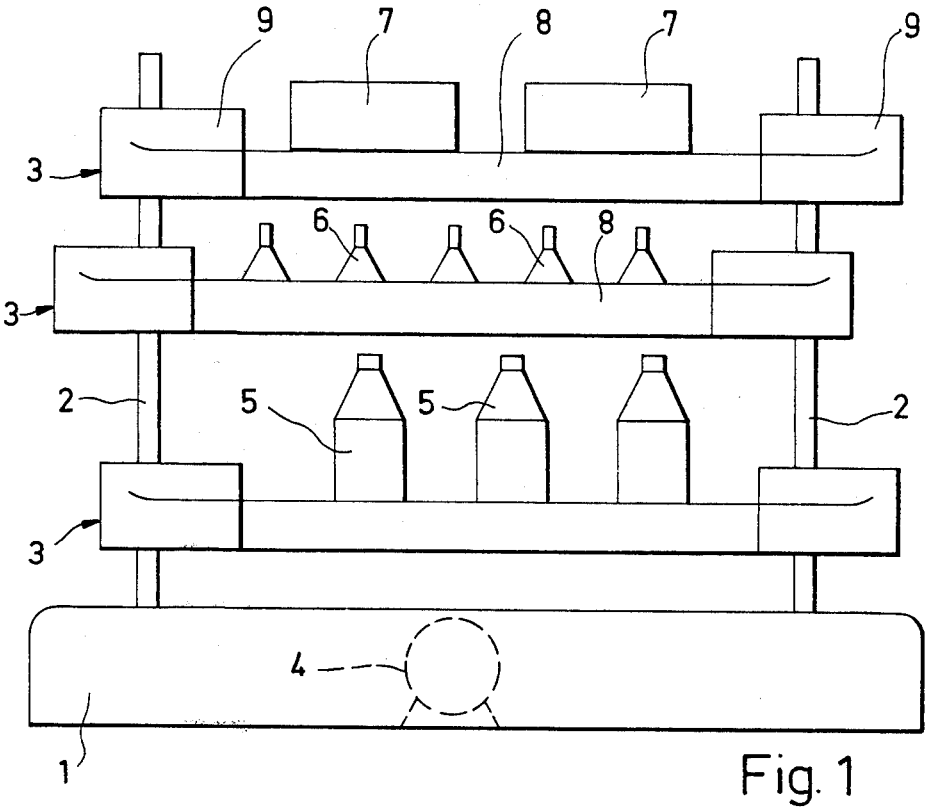
FIG. 1 is a side elevational view of a shaking machine comprising two supporting columns and three supports for the treated matter.

The shaking machine shown in FIG. 1 comprises a frame substantially formed by a base 1. In base 1, two vertical shafts 2 are mounted for rotation, and three horizontal supports 3 for the treated matter, disposed one above the other, are supported on shafts 2. Base 1 further accommodates a motor 4 serving as a drive mechanism and connected to both shafts 2, through a chain or gear transmission, in a manner such that, during operation, the shafts rotate in the same direction and in synchronism. On supports 3, there are placed trays with various vessels 5, 6, 7, containing the substance to be shaken, for example, cultures of microorganisms.

Figure 2:
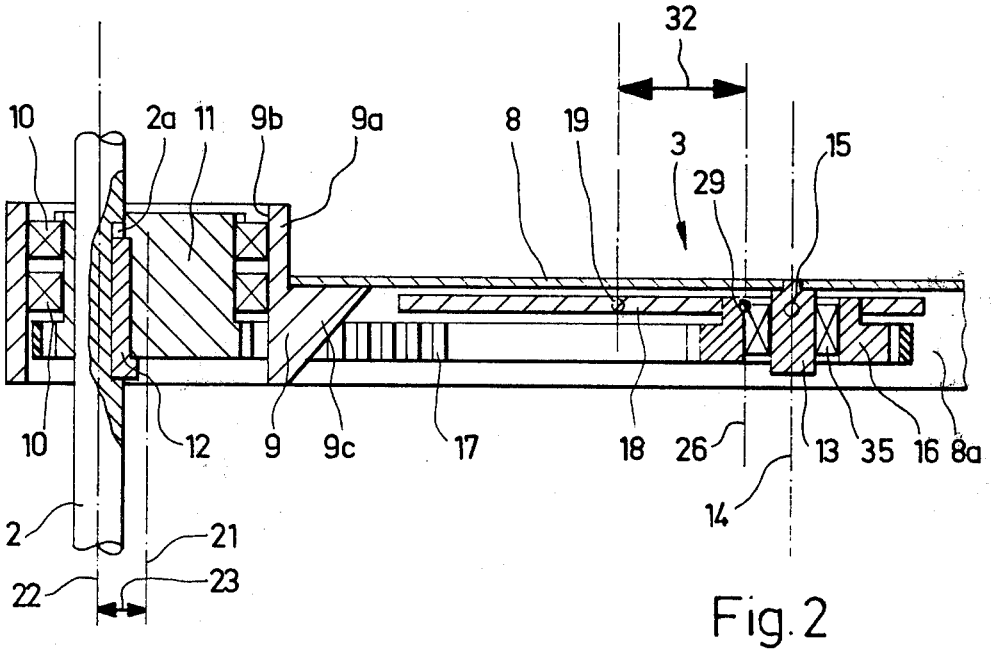
FIG. 2 is an enlarged sectional view of a part of a support having a single balance body.
Figure 3:
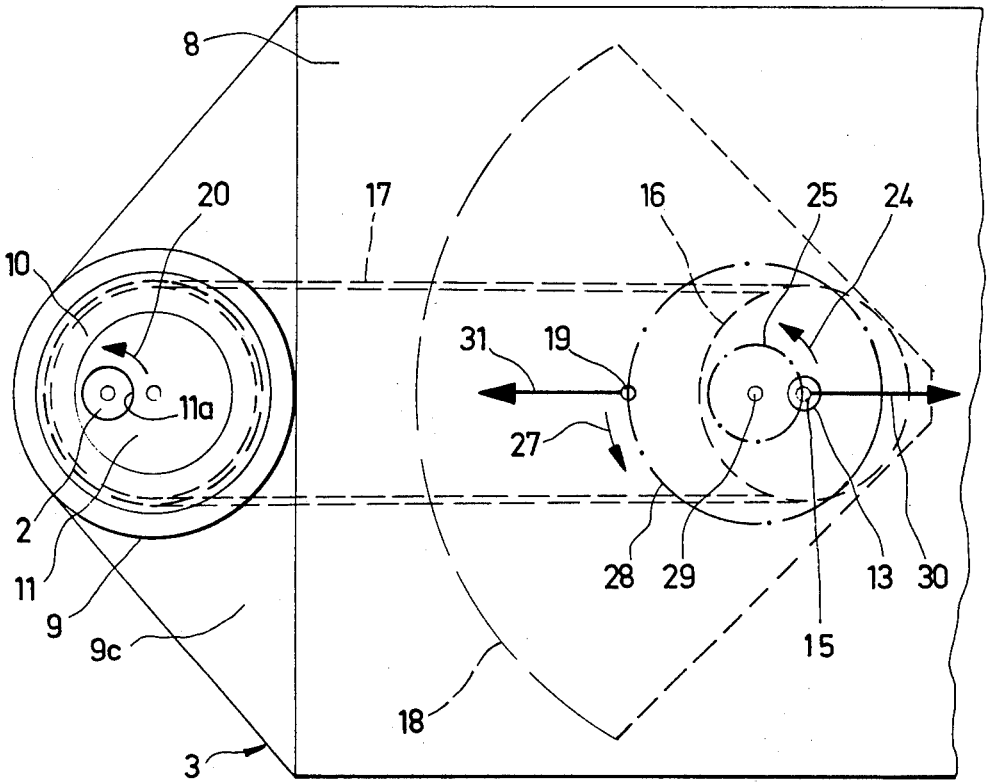
FIG. 3 is a top plan view of the support shown in FIG. 2.

Each support 3 comprises a horizontal table 8 which is provided, on its both longitudinal sides, with a reinforcing ledge 8*a* projecting downwardly in the vertical direction. Each support 3 further comprises two bearing bodies 9 which are located symmetrically at opposite ends of table 8 and designed as shown in FIGS. 2 and 3. Each bearing body 9 comprises a bushing 9*a,* with a through-bore surface 9*b* extending vertically, and a bracket 9*c,* which is rigidly connected to table 8. By means of diagrammatically indicated antifriction bearings 10, a gear 11 is mounted for rotation and secured against axial displacement in one bore 9*b,* and is formed with an eccentric bore 11*a* through which the associated shaft 2 extends. The associated shaft 2 and gear 11 are non-rotatably connected to each other by means of a key 12. Key 12 and its keyway 2*a* on shaft 2 are designed so that the shaft 2 and key 12 carry gear 11 and, thereby, the entire bearing body. The other bearing body, not shown in FIGS. 2 and 3, is substantially of the same design, but comprises only an eccentric pivot instead of a gear 11.

In the center of table 8, a vertical pin 13 is secured, the geometric axis 14 of which extends through the center of gravity 15 of support 3. By means of a diagrammatically indicated antifriction bearing 35, a gear 16 is mounted on pin 13, and has the same number of teeth as gear 11. The gears 11 and 16 are connected to each other by a transmission element, namely a gear belt 17, so that, during operation, they rotate in synchronism in the same direction. A balance body 18, having the shape of a circular sector, is non-rotatably secured to gear 16 and, thereby, to support 3. The center of gravity of balance body 18 is designated 19. As may be seen in FIG. 2, center of gravity 19 is located somewhat below the surface of table 8, in the same horizontal plane as center of gravity 15 of support 3 which center of gravity 15 is also the center of mass of the vessels placed on the support.

With the shaking machine in operation, the following motions take place and inertia forces are produced:

As shafts 2 are rotated at a constant speed, for example, in the direction indicated by arrow 20, axis 21 of gear 11 and of bushing 9*a* executes a corresponding motion about the geometric axis 22 of shaft 2. Since the shafts 2 rotate in synchronism, every point of support 3 executes a uniform, horizontal, circular motion about an axis which is stationary relative to frame or base 1. For all points, the path radii are equal to the eccentricity of bore 11*a,* i.e. equal to the distance 23 by which axes 21 and 22 are spaced from each other. In particular, center of gravity 15, which is located on axis 14, executes a motion indicated by arrow 24, along a circular path 25 and about a stationary axis 26.

Balance body 18 is connected, through gears 11 and 16, gear belt 17 and shaft 2, to drive mechanism 4 in a manner such that its center of gravity 19 executes a circular movement about axis 14, which is dephased by a phase angle of 180° relative to the movement of support 3. Considered in the stationary system, center of gravity 19 of the balance body moves, in the direction indicated by arrow 27, at a constant path velocity along a circular path 28 and about axis 26 about which also center of gravity 15 of the other parts moves. Balance body 18 is designed so that the common center of gravity 29 of loaded support 3 and of balance body 18, connected thereto, comes to be located approximately on axis 26 which is stationary relative to base 1. The two partial centers of gravity 15 and 19 and common center of gravity 29 are located on a straight line which, under ideal conditions, extends horizontally.

In case the mass and distribution of the vessels placed on support 3 do not conform exactly to the provided and desired load, center of gravity 15 and, thereby, also common center of gravity 29, may be somewhat displaced. In order to insure that such deviations from the desired load result in only small displacements of the centers of gravity, support 3 is designed so as to have a relatively large mass. For example, support 3 may have a weight of approximately five times the provided rated load. Then, a load difference deviating from the rated value by about 50% results in only a small displacement of the common center of gravity 29.

In operation, the movement of support 3 produces a centrifugal force indicated by arrow 30, which acts at center of gravity 15 and is directed outwardly of stationary axis 26. The circular motion of center of gravity 19 of the balance body 18 has the effect that another centrifugal force indicated by arrow 31 is produced, which acts in a radial direction away from axis 26. Since the two partial centers of gravity 15 and 19 move about stationary axis 26 in phase opposition and since balance body 18 is designed to that common center of gravity 29 is located on axis 26, the two centrifugal forces are of equal magnitude and opposite direction and compensate for each other. Further, since they act along the same straight line, the torques they produce are also compensated.

As follows from the foregoing, the centrifugal force produced by balance body 18 is proportional to the mass of the balance body and to the distance 32 of center of gravity 19 of the balance body from stationary axis 26. In the present example, this distance 32 is approximately equal to three times the spacing of the axes 14 and 26, i.e. equal to the eccentricity 23. Consequently, the mass of balance body 18 must amount to approximately one third of the mass of the loaded support 3.

Advantageously, supports 3 mounted one above the other are connected to shafts 2 in a manner such that they execute mutually dephased motions. In such a case, the inertia forces, still acting on the different supports and produced by a deviation of the load from the rated value, may further be compensated so that, in practice, no tilting moments act on base 1.

For tests, a shaking machine has been constructed in which the radii of the paths followed by the supports of the treated matter are 25 mm and each support has a mass of approximately 50 kg. The balance bodies were designed for obtaining a complete balance with the supports loaded with 10 kg. Under these conditions, the tests have proved that, with support loads between 5 and 15 kg, the machine can be operated at a speed up to at least 500 rpm without producing any rolling motions.

Since, in the inventive shaking machine, the inertia forces and the torques thereby produced approximately compensate each other in each individual support 3, it is easily possible to connect supports 3 to base 1 in an adjustable manner so that their spacing can be adapted to the heights of the vessels 5, 6, 7 to be shaken. For example, shafts 2 may be provided with a plurality of equidistant keyways 2*a* permitting to fix the supports at desired levels.

Another advantage of the inventive design is that, if needed, it is easily possible to increase the number of supports and, thereby, to increase the performance of the machine at low cost.

Figure 4:
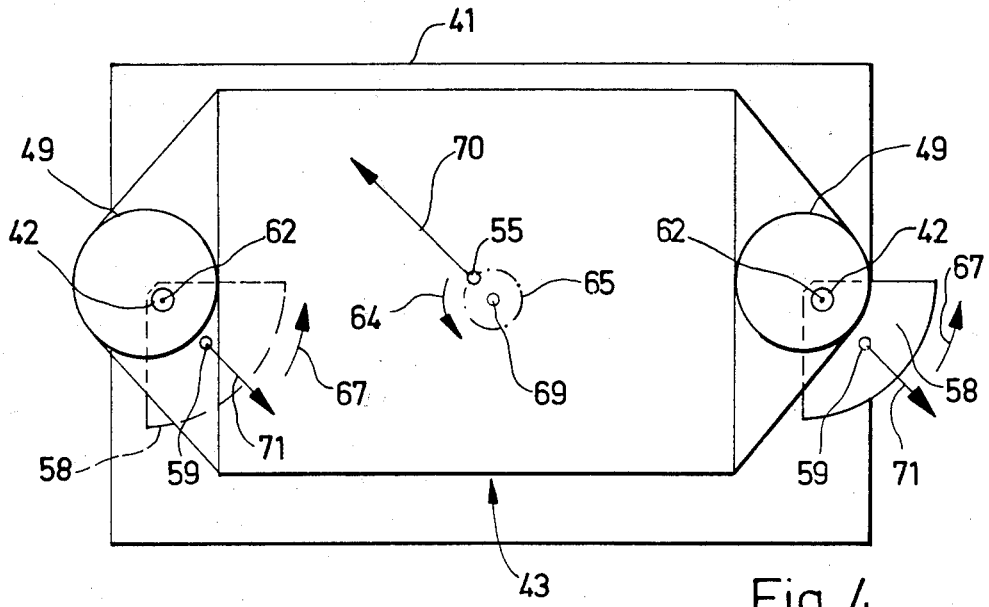
FIG. 4 is a top plan view of a support having two balance bodies.

FIG. 4 shows another embodiment of the shaking machine in accordance with the invention. This embodiment comprises a frame with a base 41 in which two drive shafts 42 are mounted for rotation. By means of bearing bodies 49, supports 43 are eccentrically mounted on shafts 42. Instead of gear 11, two balance bodies 58, comprising eccentric, sector-shaped disks, are mounted in the bearing bodies 9. With the machine in operation, the centers of gravity 59 of the two balance bodies 58 execute rotational motions in the direction indicated by arrows 67, about the stationary geometric axes 62 of shafts 42. Center of gravity 55 of support 43, in contrast thereto, executes a circular motion in phase opposition, i.e. dephased by a phase angle of 180° C, in the direction indicated by arrow 64 and about common center of gravity 69, along circular path 65. Balance bodies 58 connected to support 43 are designed so that the centrifugal forces they produce, and which are indicated by arrows 71, approximately compensate the centrifugal force which acts at center of gravity 55 of support 43 and is indicated by arrow 70.

Otherwise, the balance bodies 58 are designed identically so that the centrifugal forces they produce are equal to each other and also the torques produced by the centrifugal forces approximately compensate each other, independently of the instantaneous angle of rotation.

In some respects, of course, the machine may be modified. For example, without any difficulty, three or four shafts may be used for mounting the supports, in which case only one shaft, or all of the shafts, are driven. Then, one balance body may be provided both at the center of gravity of the supports and at each of the shafts.

While specific embodiments of the invention have been shown and described in detail to illustrate the application of the principles of the invention, it will be understood that the invention may be embodied otherwise without departing from such principles.

What is claimed is:

1. In a shaking machine of the type having a frame, a drive mechanism and at least two supports, for the matter to be treated, which are mounted one above the other and guided and connected to the drive mechanism in a manner such that, in operation, all points of the support can execute horizontal circular movements at mutually equal velocities along paths having mutually equal radii, the improvement comprising, in combination, at least one respective balance body connected to each support and mounted for rotation relative thereto in a manner such that, during operation of the machine, the center of gravity of each balance body executes a horizontal circular movement which is dephased, relative to the movement of the center of gravity of the associated support, by a constant phase angle; said balance bodies having dispositions and dimensions such that the inertia forces occurring during operation of the machine, and the torque produced thereby, substantially compensate each other; and means for rotating each said balance body comprising two gears, having equal numbers of teeth, rotatably mounted in each support, a respective transmission element interconnecting the two gears of each support, and a vertically oriented drive shaft rotatably mounted in said frame and driven by said drive mechanism; one gear on each support being non-rotatably and eccentrically supported on said drive shaft; the other gear on each support being non-rotatably connected to the balance body acting at the center of gravity of the associated support.

2. In a shaking machine, the improvement claimed in claim 1, in which each transmission element is an endless gear belt meshing with the two associated gears.

3. In a shaking machine, the improvement claimed in claim 1, in which said drive shaft extends vertically through said supports adjacent one end of each support; and a second vertically oriented drive shaft rotatably mounted on said frame and driven by said drive mechanism and extending vertically through each support adjacent the opposite end of each support; and respective pivots non-rotatably and eccentrically supported on said second drive shaft and each rotatably engaged in a respective support.

* * * * *